US007237887B2

(12) United States Patent
Ueki et al.

(10) Patent No.: US 7,237,887 B2
(45) Date of Patent: Jul. 3, 2007

(54) INK JET RECORDING DEVICE AND METHOD FOR INK JET RECORDING USING THE SAME

(75) Inventors: Hiroyuki Ueki, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 256 days.

(21) Appl. No.: 10/956,364

(22) Filed: Oct. 4, 2004

(65) Prior Publication Data

US 2005/0212884 A1 Sep. 29, 2005

(30) Foreign Application Priority Data

Mar. 24, 2004 (JP) ..... 2004-088075

(51) Int. Cl.
*B41J 2/195* (2006.01)

(52) U.S. Cl. ..... 347/101

(58) Field of Classification Search ..... 347/100, 347/101

See application file for complete search history.

(56) References Cited

U.S. PATENT DOCUMENTS

2001/0015735 A1* 8/2001 Matsumoto ..... 347/20
2003/0095170 A1* 5/2003 Johnson ..... 347/104
2003/0160850 A1* 8/2003 Ohya et al. ..... 347/101

FOREIGN PATENT DOCUMENTS

JP 2001-179959 7/2001
JP 2001179959 A * 7/2001

* cited by examiner

*Primary Examiner*—Manish S. Shah
*Assistant Examiner*—Laura E. Martin
(74) *Attorney, Agent, or Firm*—Morgan, Lewis & Bockius LLP

(57) ABSTRACT

An ink jet recording device including a recording head for depositing ink on a recording medium and a liquid absorbing device for absorbing excess liquid of the ink remaining on the recording medium after the depositing of the ink on the recording medium using the recording head, wherein the liquid absorbing device includes an absorber including a hydrophilic surface which contacts the excess liquid, and the hydrophilic surface has a residual fine particle ratio of not less than about 90%, the residual fine particle ratio being a ratio of fine particles remaining on the hydrophilic surface when fine particles having an average particle size of 5 μm are filtered by the hydrophilic surface.

10 Claims, 6 Drawing Sheets

INK JET RECORDING DEVICE AND METHOD FOR INK JET RECORDING USING THE SAME

CROSS-REFERENCE TO RELATED APPLICATION

This application claims priority under 35 USC 119 from Japanese Patent Application No. 2004-088075, the disclosure of which is incorporated by reference herein.

BACKGROUND OF THE INVENTION

1. Field of the Invention

The present invention relates to an ink jet recording device that carries out recording by ejecting ink from a recording head on a recording medium and a method for ink jet recording using the same.

2. Description of the Related Art

Recently, the spread of color documents in offices has been remarkable, and various output instruments therefore have been suggested. Specifically, inexpensive ink jet systems that allow for miniaturization are being used for various output instruments.

A recording head used for an ink jet system has energy generating means, energy converting means for converting the energy generated by the energy generating means to ink ejecting force, an ink ejection orifice from which ink droplets are ejected by the ink ejecting force, and an ink feeding pathway communicating with the ink ejection orifice for feeding ink. Examples of the energy generating means may include means using an electromechanical converter such as a piezo element, or means for heating ink using an electric heat converting element comprising a heat generating resistor to form air bubbles and for ejecting ink droplets by the generation of the air bubbles.

Such ink jet system has a problem in that the ink droplets remaining on the recording medium after depositing of the ink on the recording medium lead to setting-off of the ink to other recording media and to curling or cockle due to excess amount of ink absorbed by the recording medium, since the ink mainly consists of liquid components.

For this reason, carrying out heating or ventilating of the recording medium or the like in order to quickly dry the recording medium after depositing of the ink has often been proposed. However, there are concerns with regard to growing power consumption and device size. On the other hand, while there is a method comprising absorbing the excess liquid of ink remaining on the recording medium using blotting paper, this method is not practical because colorant components in the ink can also be absorbed by the paper.

Japanese Patent Application Laid-Open (JP-A) No. 2001-179959 discloses absorbing only excess liquid components (liquid solvent) of ink remaining on a recording medium by using a liquid absorber covered by a member having releasing property with respect to a coloring agent (colorant) after printing (after depositing of ink on a recording medium) for the purpose of absorbing only liquid components (liquid solvent) of the ink.

However, the above-mentioned method still has room for improvement because the positions for absorbing are scattered due to use of a surface layer having releasing property. Therefore, even though excess liquid of ink is absorbed, curling and cockle, and color bleeding occur due to differences in degrees of drying and penetration of ink placed on the recording medium.

SUMMARY OF THE INVENTION

The present invention provides an ink jet recording device and a method for ink jet recording using the device in which only excess liquid of ink deposited on a recording medium is absorbed, whereby setting-off of ink, and curling and cockle can be prevented, drying property of ink can be improved, and a fine image can be provided.

A first aspect of the invention is to provide an ink jet recording device comprising: a recording head for depositing ink on a recording medium; and a liquid absorbing device for absorbing excess liquid of the ink remaining on the recording medium after the depositing of the ink on the recording medium using the recording head, wherein the liquid absorbing device comprises an absorber comprising a hydrophilic surface which contacts the excess liquid, and the hydrophilic surface has a residual fine particle ratio of not less than about 90%, the residual fine particle ratio being a ratio of fine particles remaining on the hydrophilic surface when fine particles having an average particle size of about 5 μm are filtered by the hydrophilic surface.

According to the ink jet recording device of the invention, ink is deposited (printed) on a recording medium by a recording head. The excess liquid of the ink remaining on the recording medium is then absorbed by a liquid absorbing device. At this time, the ink or excess liquid is absorbed well by the liquid absorbing device without releasing, and repelling of ink can be avoided, since, in the absorbing device, the surface which contacts the excess liquid is hydrophilic. Furthermore, since the hydrophilic surface has the residual fine particle ratio in the above-mentioned range, the liquid absorbing device selectively absorbs only the excess liquid without absorbing any colorant. Accordingly, the device of the invention absorbs, with certainty, only excess liquid of ink deposited on a recording medium, whereby setting-off of ink, curling and cockle can be prevented, drying property of ink can be improved, and a fine image can be provided.

As used herein, the hydrophilic surface means a surface wherein a contact angle is not more than 35° when an aqueous solution having a surface tension of 40 mN/m is applied dropwise onto a material of the surface. In other words, ink having a surface tension of 20 mN/m to 45 mN/m wets the surface well.

The hydrophilic surface as defined herein is a surface including a material that can be wet well by water, and the hydrophilic surface may be obtained by making the surface of the hydrophobic material hydrophilic. That is, the material of the hydrophilic surface (hydrophilic material) may be a material modified to be hydrophilic by surface treatment. For example, a hydrophobic material partially treated to be hydrophilic can also be used for the invention. Specifically, a PTFE resin film having micropores for passing a liquid wherein the surface thereof has been made to be hydrophilic by plasma treatment may be used.

A second aspect of the invention is to provide a method for ink jet recording comprising: depositing ink on a recording medium using a recording head; and absorbing excess liquid of the ink remaining on the recording medium using a liquid absorbing device for absorbing the excess liquid, wherein the liquid absorbing device comprises an absorber comprising a hydrophilic surface which contacts the excess liquid, and the hydrophilic surface has a residual fine particle ratio of not less than about 90%, the residual fine particle ratio being a ratio of fine particles remaining on the hydrophilic surface when fine particles having an average particle size of about 5 μm are filtered by the hydrophilic surface.

According to the method for ink jet recording of the invention, it is possible to absorb, with certainty, only excess liquid of ink deposited on a recording medium, whereby setting-off of ink, curling and cockle can be prevented, drying property of ink can be improved, and a fine image can be provided, similarly as in the ink jet recording device of the invention.

DETAILED DESCRIPTION OF THE INVENTION

Figure 1:
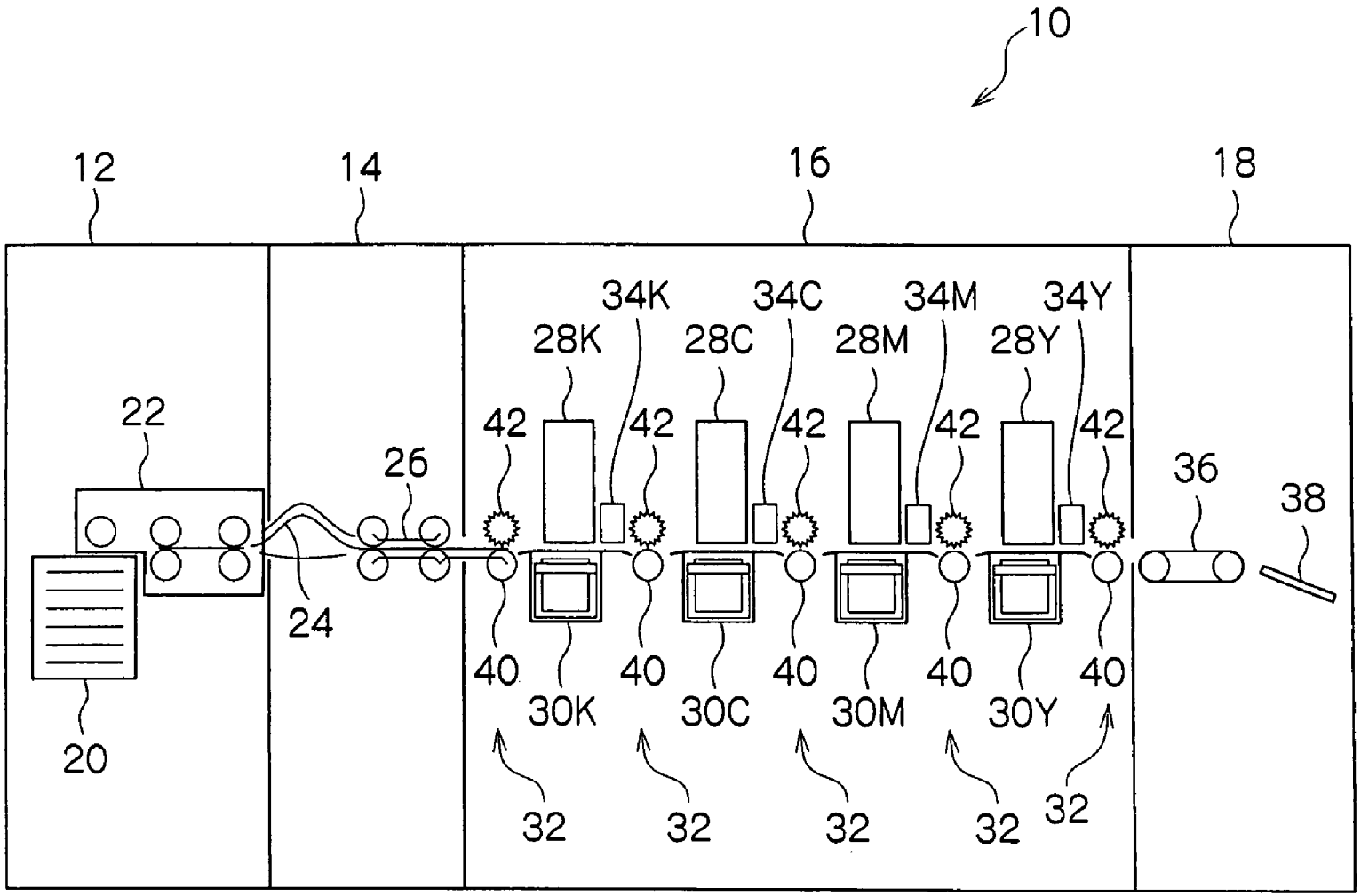
FIG. 1 is a schematic view of an ink jet recording device according to one embodiment of the present invention.

Hereinafter, an ink jet recording device of the present invention is explained in detail with reference to the drawings. In addition to the ink jet recording device of the invention, a method for ink jet recording is also explained. However, the invention is not limited thereto. Throughout the drawings, members having substantially the same function are indicated using the same reference numerals. In addition, throughout the drawings, P indicates paper (recording medium).

FIG. 1 is a schematic view of an ink jet recording device according to an embodiment of the invention.

As shown in FIG. 1, the ink jet recording device 10 basically includes a paper feeding portion 12 for feeding paper, a registration adjusting portion 14 for adjusting the position of the paper, a recording portion 16 for forming an image on paper (image recording medium) using ink, and a paper ejecting portion 18 for ejecting paper on which an image has been formed by the recording portion 16.

The paper feeding portion 12 basically includes a stacker 20 in which paper sheets are stocked in a pile and a conveying device 22 for sheet-feeding a sheet of paper from the stacker 20 and conveying the sheet to the registration adjusting portion 14.

The registration adjusting portion 14 has a loop forming portion 24 and a guide member 26 for controlling the position of the paper. The paper passes the portion, whereby skew of the paper is corrected by utilizing elasticity of the paper and conveying timing is controlled, and the paper enters into the recording portion 16.

The recording portion 16 basically includes recording heads 28 for depositing ink on the paper (recording medium) for forming an image, maintenance devices 30 provided facing nozzle surfaces of the recording heads 28 and conveying means 32 for conveying paper between the recording heads 28 and the maintenance devices 30. The recording heads 28 can provide full-color printing by printing with black (K), cyan (C), magenta (M) and yellow (Y) ink in this order from the upstream side in the conveying direction. Where necessary, the recording head for each color is identified by assigning reference symbols K, C, M and Y to the reference numeral (as recording heads 28K, 28C, 28M and 28Y). Hereinafter, the same is also applied to other members (maintenance devices 30K to 30Y, liquid absorbing devices 34K to 34Y).

Liquid absorbing devices 34 for absorbing excess liquid of the ink respectively deposited on the paper by the recording heads 28K to 28Y are respectively provided at downstream sides of the recording heads 28K to 28Y. Each color of ink is respectively deposited on the paper by the corresponding recording head 28, and thereafter excess liquid of ink of each color on the paper is respectively absorbed by the corresponding liquid absorbing device 34.

Each recording head 28 and each maintenance device 30 is formed as a unit, and the recording head 28 and maintenance device 30 can be separated from each other with a paper conveying pathway therebetween. Accordingly, if a paper jam occurs, the jammed paper can be easily removed.

In the paper ejecting portion 18, the paper on which an image has been formed by the recording portion 16 is loaded into a tray 38 via a paper ejecting belt 36.

The ink used herein is a single liquid-type ink set including ink containing at least a colorant, a water soluble solvent and water. In this embodiment, as mentioned above, black ink, cyan ink, magenta ink and yellow ink are each ejected from the recording heads 28K to 28Y, respectively. The ink is explained in more detail below.

Next, the liquid absorbing device 34 is explained.

As the liquid absorbing device, a roll-type device, a belt-type device, a take-up-type device, or the like can be used. Any of these devices enables excess liquid of ink to be absorbed efficiently with a simple structure.

Figure 2:
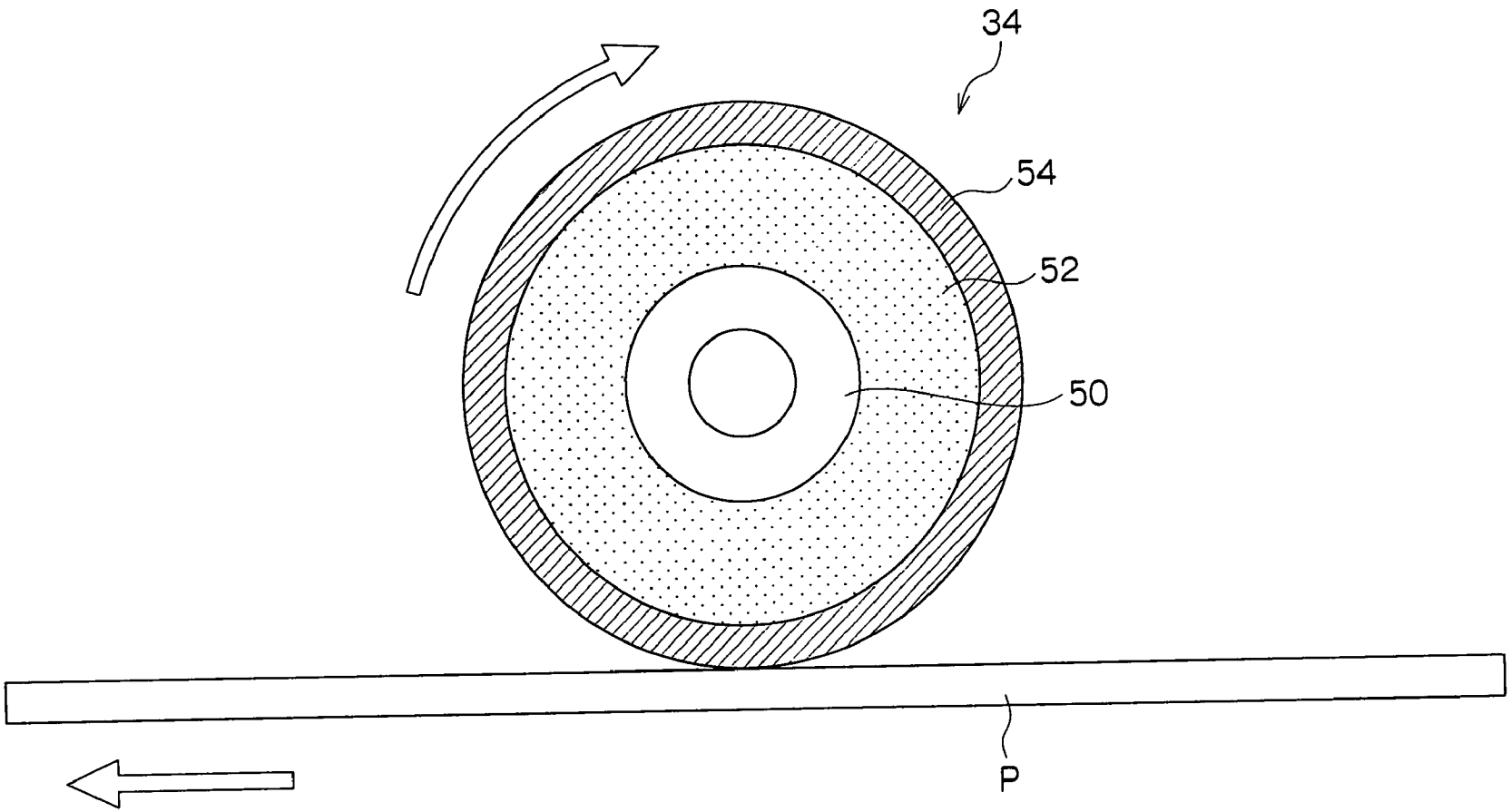
FIG. 2 is a schematic view of an example of a liquid absorbing device of the ink jet recording device according to one embodiment of the invention.

The specific structure of the liquid absorbing device 34 is explained in detail below. Examples of the liquid absorbing device 34 include a roll-type liquid absorbing device 34 as shown in FIG. 2, which has a liquid absorbing roll including a metal shaft 50, and an absorbing layer 52 and a hydrophilic layer (hydrophilic absorbing layer) 54 laminated on the outer peripheral surface of the metal shaft 50 in this order.

The hydrophilic layer 54 is the member constituting the surface which contacts the excess liquid of the ink, and the layer includes a hydrophilic material. The hydrophilic material is preferably a material wherein a contact angle is not more than 35° when an aqueous solution consisting of 99% of pure water and 1% of Surfinol 465 (trade name, manufactured by Nisshin Chemical Co., Ltd.) is applied dropwise thereon. Examples thereof may include hydrolyzed materials such as cellulose, starch, gelatin and acrylic fiber, cross-linked polyacrylic acid salts, hydrophilized polyester, hydrophilized olefin, hydrophilized rayon, PVA fiber, and hydrophilized poly(vinylidene fluoride).

The hydrophilic layer 54 contacts the excess liquid of the ink. The excess liquid is then absorbed by the absorbing layer 52 through the hydrophilic layer 54. Accordingly, the hydrophilic layer 54 substantially allows only the excess liquid to pass without allowing the colorant to pass.

Specifically, the hydrophilic layer 54 by itself has a residual fine particle ratio of not less than about 90%, the residual fine particle ratio being a ratio of fine particles remaining on the hydrophilic layer when fine particles having an average particle size of about 5 μm are filtered by the hydrophilic layer. Since the hydrophilic layer 54 has the residual fine particle ratio of not less than about 90% for the particles having an average particle size of about 5 μm, it does not allow a colorant to pass but substantially allows only the excess liquid to pass. The residual fine particle ratio can be obtained as follows. The number of particles of 5 μm or larger is measured using an Accusizer 770 Optical Particles Sizer (trade name, manufactured by Particle Sizing Systems) before and after filtration. 2 μl of aqueous ink jet recording liquid is fed into a measurement cell and the measurement is carried out in accordance with a predetermined measurement method. The obtained value is converted into a desired unit and the residual fine particle ratio is calculated as follows.

Residual fine particle ratio=[(number of particles of not less than 5 μm measured before filtration)−(number of particles of not less than 5 μm measured in filtrate)]/(number of particles of not less than 5 μm measured before filtration).

The hydrophilic layer 54 preferably has plural pores (apertures). A pore diameter (maximum diameter) is preferably about 0.5 μm to about 50 μm, more preferably 1 μm to 20 μm, and further preferably 5 μm to 10 μm. The thickness of the layer is preferably 0.01 mm to 10 mm, and more preferably 0.1 mm to 1.5 mm. The thickness of the layer is preferably not less than five times the average pore diameter. If the pore diameter exceeds the above-mentioned range, the colorant and the excess liquid may not be separated, and the colorant may be absorbed together with the excess liquid by the absorbing layer 52. On the other hand, when the pore diameter is less than the above-mentioned range, the amount of the excess liquid to be passed may decrease, which may cause difficulty in efficient absorbing by the absorbing layer 52.

The area percentage of the pores is preferably about 10% to about 70%, and more preferably 15% to 50% relative to the area of the surface of the hydrophilic layer 54. By adjusting the area percentage of the pores to within the above-mentioned range, the excess liquid can pass through the pores of the hydrophilic layer 54 more effectively, which allows good absorption of the excess liquid by the absorbing layer 52.

Alternatively, the hydrophilic layer 54 may be made of a hydrophobic material having micropores for passing liquids (e. g., PTFE resin film), whose surface has been made to be hydrophilic by plasma treatment. etc.

The absorbing layer 52 preferably includes a porous body or a fibrous body from the viewpoint of efficient absorbing of the excess liquid, because the excess liquid which contacts the hydrophilic layer 54 is absorbed by the absorbing layer 52 through the hydrophilic layer 54. Examples of the material of the absorbing layer may include, natural fibers such as wool, cotton and silk, chemical fibers such as polyester, polyamide, polyacrylonitrile, polypropylene, cellulose, urethane and melamine, and a porous body. In order to control strength or a surface state, organic or inorganic filler may be contained in the above materials.

The absorbing layer 52 preferably has a structure in which fiber density or pore density is increased from the outer surface to the inner surface. Having such a structure, the excess liquid absorbed by the hydrophilic layer 54 can be moved to the inner surface (towards the metal shaft 50) by a capillary phenomenon.

Figure 3:
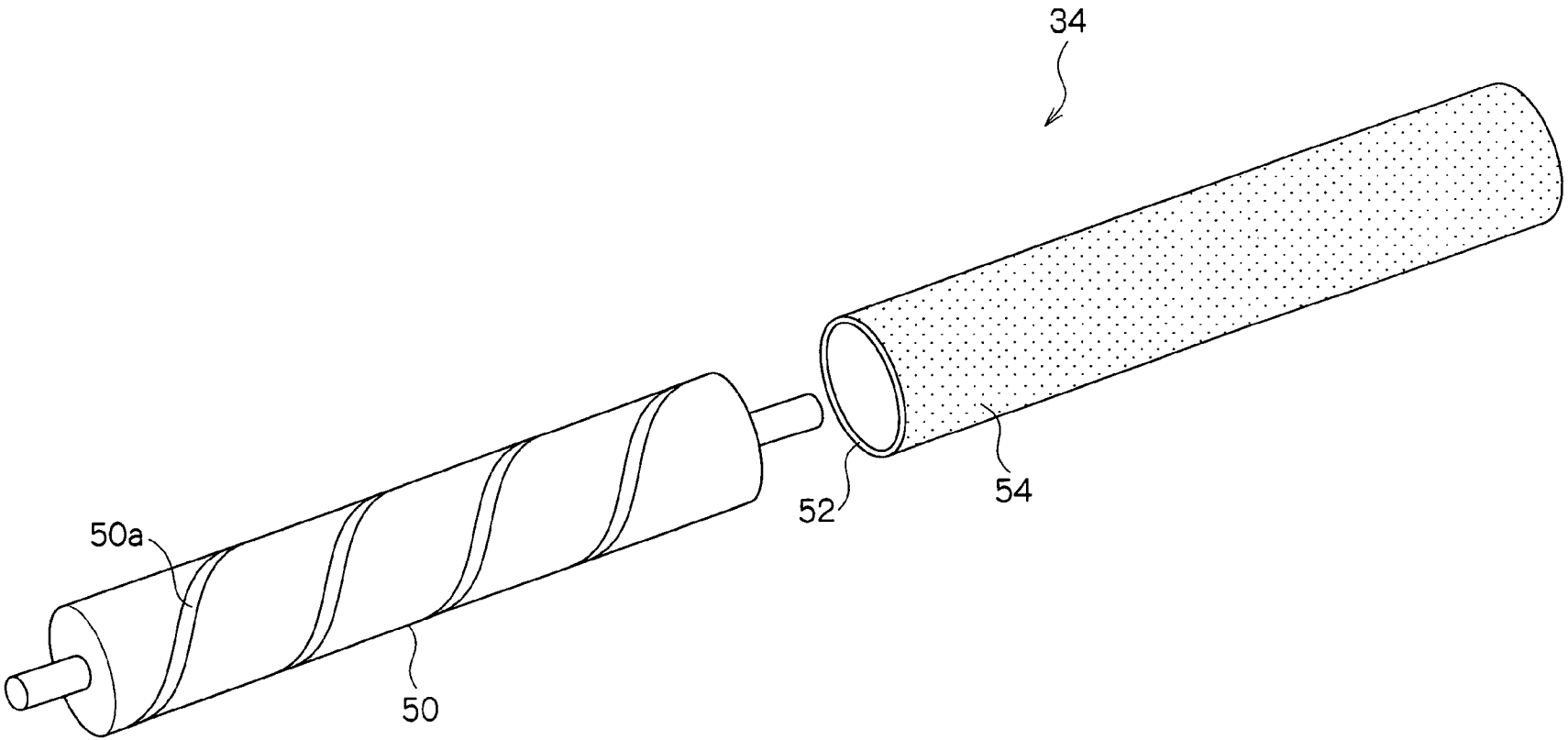
FIG. 3 is a perspective view of an example of a liquid absorbing device of the ink jet recording device according to one embodiment of the invention.

The metal shaft 50 includes a metal material such as stainless steel or aluminum. As shown in FIG. 3, the outer peripheral surface of the metal shaft 50 has a helical groove 50*a* formed therein.

In the roll-type liquid absorbing device of the present embodiment, the excess liquid of the ink remaining on the paper contacts the surface of the hydrophilic layer 54 while the liquid absorbing roll is rotating, and the excess liquid is absorbed by the absorbing layer 52 through the hydrophilic layer 54. The excess liquid absorbed by the liquid absorbing layer 52 then reaches the groove 50*a* of the metal shaft 50, and the excess liquid moves to the end thereof through the groove 50*a* due to the rotation of the metal shaft 50 and is collected in a collecting vessel (not depicted). In this way, the excess liquid of the ink on the paper (recording medium) is absorbed and collected.

Figure 4:
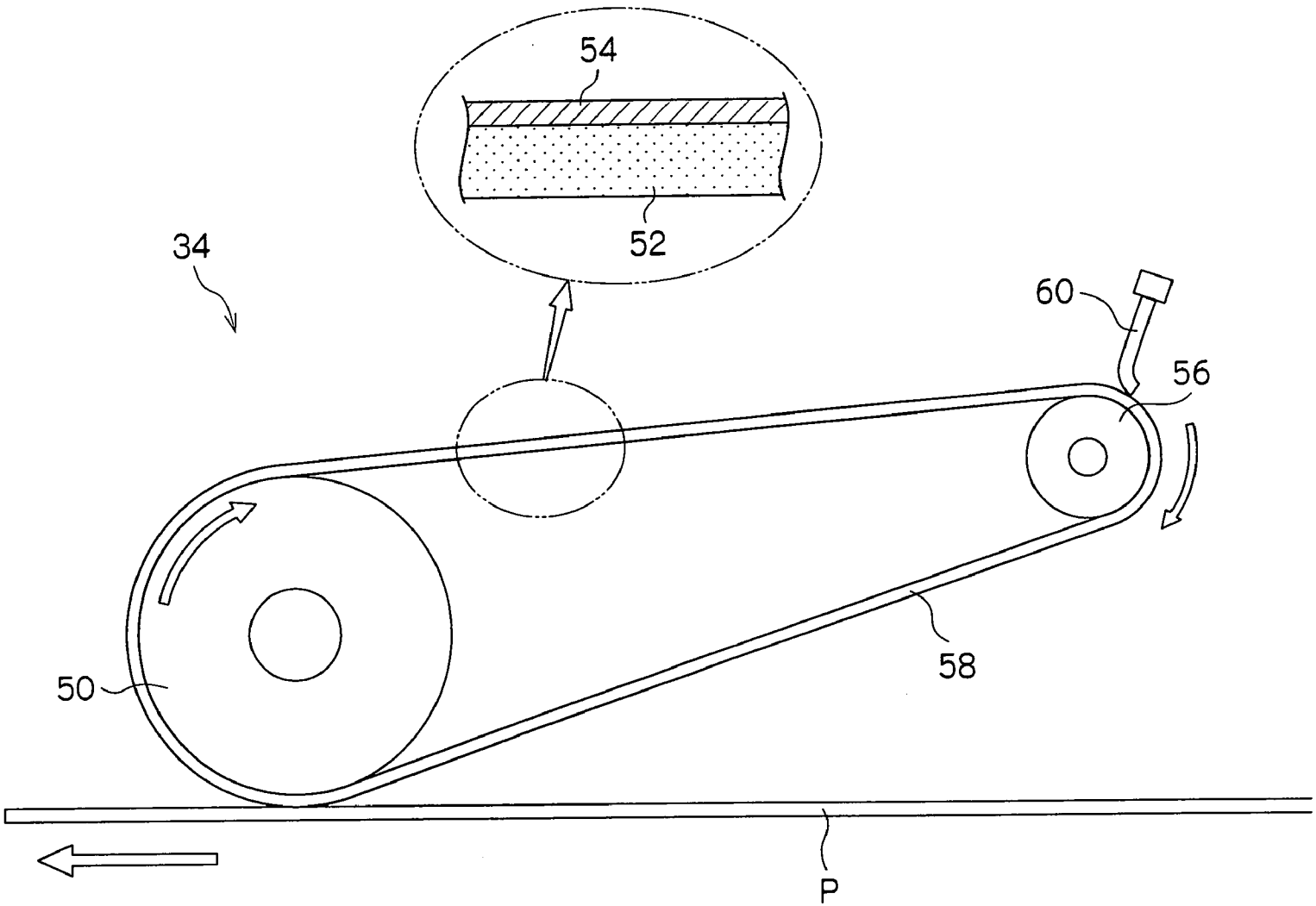
FIG. 4 is a schematic view of another example of a liquid absorbing device of the ink jet recording device according to one embodiment of the invention.

Examples of other embodiments of the liquid absorbing device 34 include, as shown in FIG. 4, an endless belt-type liquid absorbing device 34, which has a metal shaft 50, a tautening shaft 56, a liquid absorbing endless belt 58 tautened between the two shafts, and a blade 60 for cleaning the liquid absorbing endless belt surface.

The liquid absorbing endless belt 58 has a layer structure including, from the inner side of the layer structure, an absorbing layer 52 and a hydrophilic layer 54 laminated on the absorbing layer, wherein these layers may also have the same structure as those of the roll-type device. The metal shaft 50 also has a helical groove 50*a* on the outer peripheral surface thereof. In addition, on the outer peripheral surface of the tautening shaft 56, a similar helical groove is provided (not depicted).

In the endless belt-type liquid absorbing device 34 of this embodiment, the endless belt 58 is rotated in accordance with the rotation of the metal shaft 50 or the tautening shaft 56, whereby the excess liquid of the ink on the paper (recording medium) is absorbed in the same manner as in the above-mentioned roll-type liquid absorbing device 34.

Figure 5:
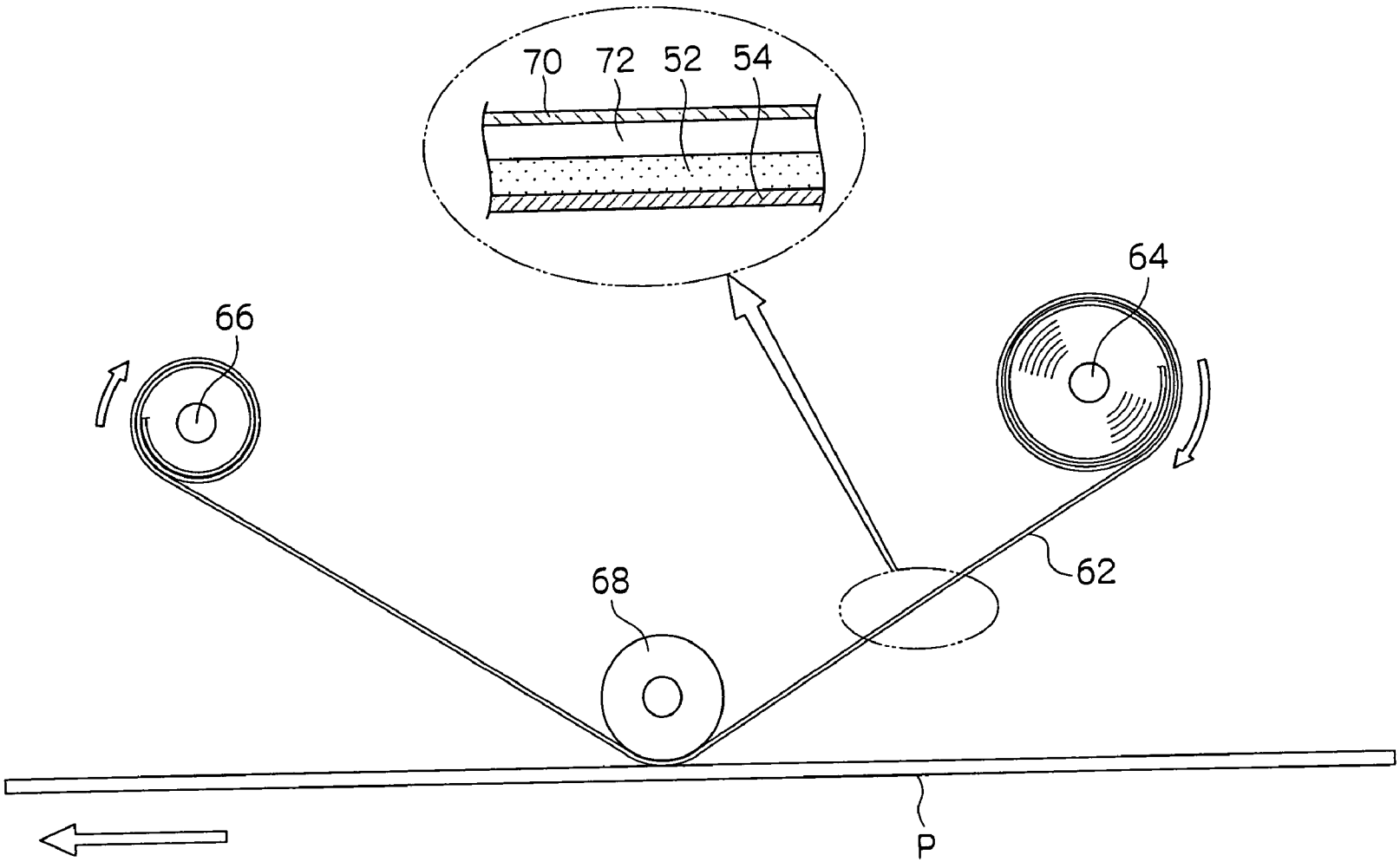
FIG. 5 is a schematic view of an example of a liquid absorbing device of the ink jet recording device according to one embodiment of the invention.

Other examples of the liquid absorbing device 34 include, as shown in FIG. 5, a take-up-type liquid absorbing device which has take-up-sheet 62 for absorbing liquid, a roll 64 on which the take-up-sheet 62 is wound, a take-up roll 66 for taking up the take-up sheet 62 wound on the roll 64 from one end, and a pressing roll 68 for pressing the take-up sheet from the side of the surface, of the take-up sheet 62, that is wound on the rolls (winding surface side of the take-up sheet 62).

The liquid absorbing take-up sheet 62 has a structure in which a liquid permeation prevention layer 70, a liquid retention layer 72, an absorbing layer 52 and a hydrophilic layer 54 are laminated in this order from the winding surface side of the take-up sheet 62, and the absorbing layer 52 and the hydrophilic layer 54 may have the same structure as those of the above-mentioned roll-type device. It should be noted that this embodiment does not have the groove 50*a* which is provided on the metal shaft 50 for collecting the excess liquid, whereas the above-mentioned roll-type device does have the groove 50*a*. Accordingly, in order to achieve higher liquid retention ability, the liquid retention layer 72 is provided between the liquid permeation preventing layer 70 and the liquid absorbing layer 52.

Preferable examples of the material of the liquid retention layer 72 include hydrophilic polymer powder. Examples of such a water soluble polymer may include starch-type polymers, cellulose-type polymers and synthetic polymers, and specifically include, for example, cross-linked polyacrylic acid salt-type polymers, isobutylene/maleic acid-type polymers, starch/polyacrylic acid salt-type polymers and PVA/polyacrylic acid salt-type polymers.

The material of the liquid permeation preventing layer 70 may be any material so long as it can prevent leaking of the excess liquid held by the liquid retention layer 72 to the winding surface side of the take-up sheet 62. Examples thereof may include polyethylene, polyethylene terephthalate, polypropylene, poly(vinyl chloride) and poly(vinylidene fluoride).

In the take-up-type liquid absorbing device of this embodiment, the surface of the hydrophilic layer 54 contacts the excess liquid of the ink remaining on the paper by the pressing roll 68 while the liquid absorbing take-up sheet 62 is being taken up by the take-up roll 66, and the excess liquid is absorbed by the absorbing layer 52 through the hydrophilic layer 54. The excess liquid absorbed by the liquid absorbing layer 52 then reaches the liquid retention layer 72, and the excess liquid is retained at the liquid retention layer 72 and collected. The take-up sheet 62 taken up by the take-up roll 66 may be used to absorb the excess liquid while being taken up by the roll 64 again.

Each of the above mentioned-liquid absorbing devices 34 preferably has an absorbing area corresponding to the maximum paper width of the paper, similarly to the recording head 28 which will be described below. In addition, in each of the liquid absorbing device 34, the layers included in the liquid absorbing device 34 are not necessarily different members and may be integrally formed of the same material.

Next, the recording head 28, the maintenance device 30 and the conveying means 32, which are included in the recording portion 16, are explained in turn.

The recording head 28 may be a thermal-type ink jet which transfers ink directly on paper in non-contacting manner, a piezo-type ink jet, a continuous flow-type ink jet or an electrostatic suction-type ink jet.

Figure 6:
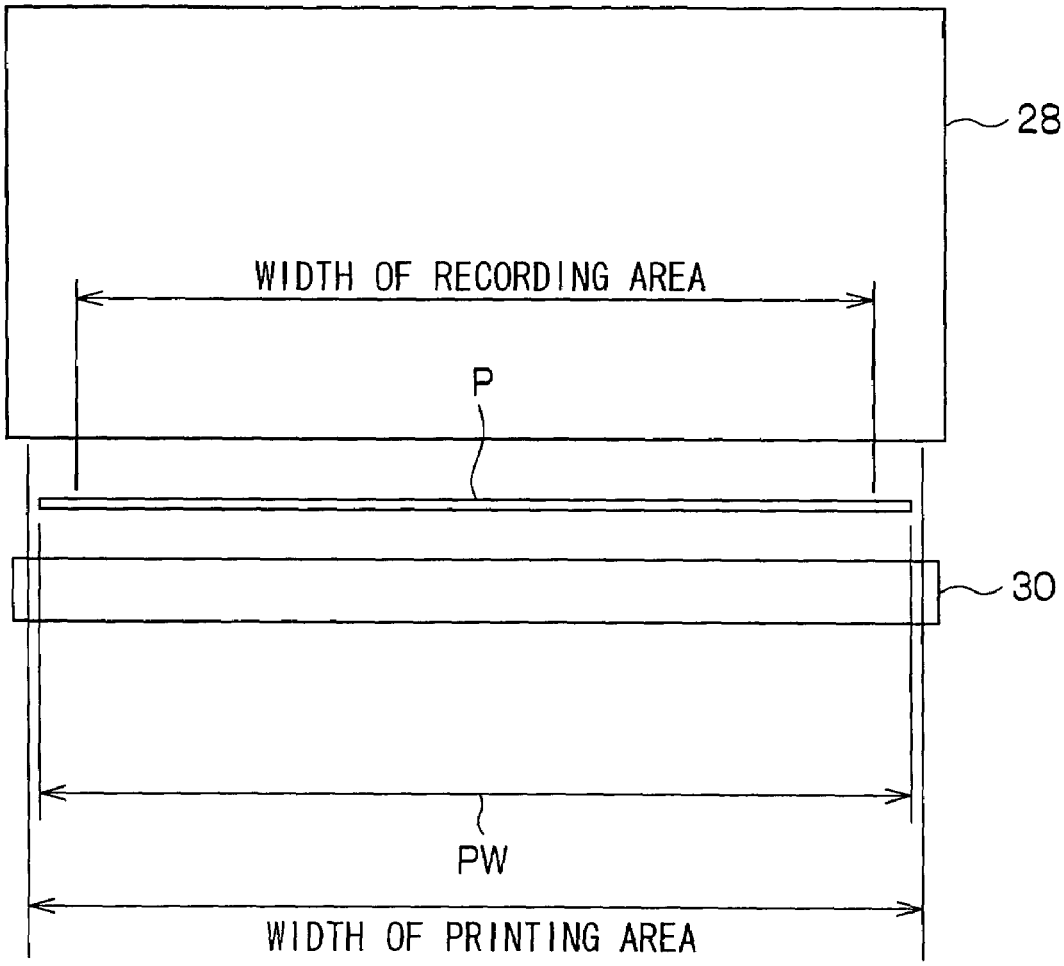
FIG. 6 is a schematic view of an example of a recording head of the ink jet recording device according to one embodiment of the invention.

As shown in FIG. 6, the recording head 28 has a printing area corresponding to the maximum paper width (PW) of the paper, which allows printing on the whole width of the paper without scanning the recording head 28. Namely, a recording head 28 having a structure by which printing can be completed while the paper passes under the recording head 28 one time is preferably used. When such a recording head is used, excess liquid may increase, and deterioration of image quality easily occurs due to high-speed printing. However, even in this case, good result can be obtained according to the invention.

If the paper has a printing margin, the printing area of the recording head 28 has a width corresponding to (not less than) the width of the recording area obtained by subtracting the printing margin from the maximum paper width (PW).

It is generally preferable that the printing area width of the recording head 28 is larger than the recording area width, because the paper may be conveyed while inclined at a certain angle relative to the conveying direction (skewing) and because marginless printing is sometimes desired.

The recording head 28 may include a monolithic, elongated heads (head chip) in which nozzles are formed in a line through the printing area, but the head preferably has a combination of short heads (head chips, hereinafter referred to as unit recording heads). The unit recording heads (short heads) can be produced in large numbers easily, and it is significantly easier to improve the process yield of the individual short heads than that of the monolithic long head. Accordingly, the recording head 28 constituted by the combination of unit recording heads can be produced at lower cost than that required for the long head.

For example, the recording head 28 may be structured so that printing can be carried out in the printing area continuously, as follows. Unit recording heads in which nozzles are provided in a line on the nozzle surface are attached to two common substrates with the lines of nozzles arranged in line. The substrates are then placed so that the nozzles are placed alternately. In this case, the recording head can be used interchangeably with an inexpensive device (recording head) that is produced in large numbers. Accordingly, the recording head 28 which can print whole width can be provided at low cost.

A commercially available or known serial recording-type ink jet recording head may be used as the unit recording head. The unit recording head may be constituted by only head chips in which ink is supplied by an ink flow pathway provided on each common substrate for the plural head chips. It is preferable that each of the unit recording heads can be replaced.

Alternatively, the recording head 28 may have unit recording heads continuously-arranged in the width direction with the unit recording heads each having nozzles formed to the end portion thereof in the direction in which the nozzles are arranged. It is required that the end portions of the unit recording heads are formed with high precision in order to align the nozzle pitch at the connecting portions of the unit recording heads. However, this structure allows for the greatest reduction in size of the recording head 28.

The arrangement of the nozzles on the unit recording head may be a straight line, but is not limited thereto. For example, nozzles can be aligned in staggered manner.

The maintenance device 30, which is placed opposing the recording head 28, comprises an ink receiving portion in which ink ejected from the recording head 28 at least when printing is not carried out is received, and maintains uniform printing (ejection of ink) property of the recording head 28. Since the maintenance device 30 having ink receiving portion is placed opposing the recording head 28, the ink transferred from the recording head 28 can be housed therein, with certainty, when printing is not carried out.

Due to drying of the ink (especially of aqueous ink or solvent ink), it is necessary for the recording head 28 to eject ink when printing is not carried out (hereinafter referred to as "dummy jetting") for the purpose of initializing ejection property.

In the case where oily ink or solid ink, which hardly dries, is used, dummy jetting is required for the purpose of initializing the ejection property by eliminating the effect of micro air bubbles generated during printing in the recording head 28 or the effect of ink or micro dust adhered on the surface of the nozzles (ink ejection surface).

The maintenance device 30 (ink receiving portion) houses the ink ejected during dummy jetting, and may include an ink absorbing member so that the housed ink is not scattered. Alternatively, the ink maintenance device 30 may have a structure in which ink is drained to a drain means provided at another location via an ink permeation member or a tube member.

It is sufficient that the maintenance device 30 has at least the above-mentioned ink receiving function, but the maintenance device 30 may further have other maintenance functions so as to maintain the ink ejecting property. For example, the maintenance device 30 may have a wiper member for cleaning the nozzle surface, or may have a capping function that protects the nozzle surface by tightly adhering to the surface. Alternatively, the maintenance device 30 may have a vacuum function for sucking ink from the nozzles.

It is not necessary for the maintenance device 30 to have functions other than the ink receiving function, e.g., the above-mentioned wiping function, capping function, or the like. The recording head, for example, may have a device for such functions (wiping device, capping device, or the like).

The conveying means 32 conveys paper by a means other than electrostatic adsorption (hereinafter referred to as a non-electrostatic adsorption device). Namely, the conveying means 32 is not specifically limited so long as it can convey paper stably at a constant velocity between the recording head 28 and the maintenance device 30. For example, a combination of a conveying roll or a conveying belt and a pressing means can be applied.

In addition, it is preferable that the conveying means 32 is positioned at a position different from that of the recording head 28 in the conveying direction so that the maintenance device 30 can be easily provided at the position opposing the recording head 28.

For example, the conveying means 32 may have a conveying roll 40 that provides driving force to the paper by contacting the rear surface of the paper and urging means (not depicted) that presses the paper towards the conveying roll 40.

This is because, if the electrostatic adsorption device is adopted, electrostatic adsorption may be unstable depending on the thickness of the paper and the material of the paper. On the other hand, the driving force can be transmitted with certainty, irrespective of the thickness or material of the paper, by pressing the paper towards the conveying roll 40 using the urging means, which allows stable conveyance of the paper.

Examples of the urging means include a device in which an urging member is directly contacted with the paper to allow urging, and a device in which an urging member is not contacted directly with the paper. The latter device includes, for example, a device comprising means for blowing air, or the like. This device is excellent, because it does not contact with the printed paper.

On the other hand, as an example of the former device, this embodiment adopts a star wheel 42 including a spring in which urging force is applied by the spring through a shaft (not depicted). Accordingly, the paper is pressed towards the conveying roll 40 by the star wheel 42 elastically urged towards the conveying roll 40 irrespective of the thickness or material of the paper. As a result, driving force is transmitted with certainty from the conveying roll 40, which allows stable conveyance of the paper.

The shape of the star wheel 42 is not specifically limited so long as the area contacting the paper is minimized. The material for the star wheel 42 may be metal or plastic. Preferable examples thereof include an SUS631H material obtained by curing treatment of SUS631H at high temperature. Examples of the production method thereof include, but are not specifically limited to, etching, pressing and laser beam machining.

Accordingly, even though the star wheel 42 contacts the recording surface of the paper, the area contacting the recording surface immediately after transfer of ink can be minimized, whereby the effect on the printing image quality can be minimized.

The pressing force applied on the star wheel 42 urged via a shaft is preferably 49.03325 mN to 294.1995 mN (5 gf to 30 gf, and more preferably 98.0665 mN to 196.133 mN (10 gf to 20 gf. If the pressing force is less than 49.03325 mN (5 gf, the paper cannot be sufficiently urged. On the other hand, if the pressing force is more than 294.1995 mN (30 gf), the paper may be damaged.

In the case where a group of star wheels is constituted by plural star wheels 42, it is preferable that the star wheels are supported by a common shaft, and the interval of the star wheels 42 is preferably not more than 50 mm so that local lifting or deformation can be suppressed.

In the case where the printing area is large, it is preferable to divide the shaft into plural shafts and to support plural star wheels 42 with each shaft. This is because, otherwise, the shaft bends and the star wheels 42 urge the paper unevenly, which leads to failure to suppress local lifting or deformation of the paper.

Any conventionally known conveying roll may be applied as the conveying roll 40. Those having a high surface friction coefficient and excellent antiwearing property are preferred for securely transmitting driving force to the paper. Examples thereof include a rubber roll in which rubber has been coated on the outer peripheral surface of a metal roll and a ceramic roll in which ceramic powder has been coated on the outer peripheral surface of a metal roll.

Next, ink is explained.

The ink includes water, a water soluble organic solvent and a colorant as components. The ink may include, if necessary, a coagulant, a dispersant, a penetrant, urea and/or a urea derivative, a pH adjusting agent or other additives. Hereinafter, the compositions of ink are explained.

Colorant

Examples of the colorant include pigments and dyes. Either of dye and pigment can be used as a colorant, and pigment is preferably used since it can be easily separated from the excess liquid (liquid solvent) and is difficult to be absorbed by the liquid absorbing device 34.

Examples of the pigment include carbon blacks and color pigments.

Preferable examples of the carbon black include carbon black pigments such as furnace black, lamp black, acetylene black and channel black. For example, Raven 7000, Raven 5750, Raven 5250, Raven 5000 ULTRA II, Raven 3500, Raven 2500 ULTRA, Raven 2000, Raven 1500, Raven 1255, Raven 1250, Raven 1200, Raven 1190 ULTRA II, Raven 1170, Raven 1080 ULTRA, Raven 1060 ULTRA, Raven 790 ULTRA, Raven 780 ULTRA and Raven 760 ULTRA (these are manufactured by Colombian Carbon); Regal 400R, Regal 330R, Regal 660R, Mogul L, Monarch 700, Monarch 800, Monarch 880, Monarch 900, Monarch 1000, Monarch 1100, Monarch 1300 and Monarch 1400 (these are manufactured by Cabot Corporation); Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A and Special Black 4 (these are manufactured by Degussa, Inc.); and No. 25, No. 33, No. 40, No. 47, No. 52, No. 900, No. 2300, MCF-88, MA600, MA7, MA8, MA100 (these are manufactured by Mitsubishi Chemical, Inc.) can be used. Alternatively, carbon black pigment newly synthesized for the invention may be also used.

Magnetized fine particles such as magnetite and ferrite, titanium black, or the like may be used in combination with the carbon black pigment. Three primal color pigments of cyan, magenta and yellow, specific pigments such as red, green, blue, brown and white, metal gloss pigments such as gold and silver, colorless body pigment and plastic pigment can also be used.

The carbon black may be self-dispersing pigment. The self-dispersing pigment means a pigment that can disperse in itself in a solvent without using a dispersant such as a surfactant or a polymer dispersant. Generally, the self-dispersing pigment has hydrophilic functional groups on its surface.

Whether the carbon black (pigment) is "self-dispersing" or not can be confirmed by the self-dispersing property test mentioned below.

Self-dispersing property test: A pigment to be measured is added to water. The mixture is dispersed using an ultrasonic homogenizer, a nanomizer, a microfluidizer or a ball mill without a dispersant, and the dispersant is diluted with water so that the initial pigment concentration becomes about 5%, whereby dispersion is prepared. The initial pigment concentration is measured, and the dispersion (100 g) are charged in a glass bottle having a diameter of 40 mm and stood still for a day. The pigment concentration of in the upper layer portion is measured. Where the ratio of the pigment concentration after standing still for a day relative to the initial pigment concentration (hereinafter referred to as "self-dispersion index") is not less than 98%, the pigment is evaluated to as "self-dispersing".

The measurement method of the concentration of carbon black (pigment) is not specifically limited, and any method such as a method including drying a sample and measuring a solid component or a method including diluting a sample to a suitable concentration and evaluating the concentration from transmittance may be used. If any method that can obtain the pigment concentration accurately exists, such method naturally can be used.

The method for introducing hydrophilic functional groups in the carbon black (pigment) may be of a known method or a newly conceived method. Examples of the method may include known methods such as oxidation treatment using an oxidizing agent (e.g., nitric acid, permanganate, bichromate, hypochlorite, ammonium persulfate, hydrogen peroxide, ozone, ozone water, or the like), treatment using a sulfonating agent, treatment using a coupling agent such as silane compound, polymer grafting treatment, plasma treatment, treatment using a diazonium salt compound having hydrophilic groups, as well as a newly conceived method, or a combination of any of these methods. The amount of the hydrophilic functional groups can be adjusted by controlling treating concentration, time period, or the like. Alternatively, the functional groups on the surface of a commercially available self-dispersing pigment can be adjusted by modification such as esterification, or the like Examples of the commercially available self-dispersing pigment that can be used as carbon black (pigment) may include MICROJET (BONJET) BLACK CW-1 (manufactured by Orient Chemical Industries, Ltd.), BONJET BLACK CW-2 (manufactured by Orient Chemical Industries, Ltd.), BONJET BLACK CW-3 (manufactured by Orient Chemical Industries, Ltd.), CAB-O-JET 200 (manufactured by Cabot Corporation), CAB-O-JET 300 (manufactured by Cabot Corporation) and IJX-157 (manufactured by Cabot Corporation). These commercially available self-dispersing pigments all have a self-dispersion index of 100%.

Examples of the color pigment may include the following pigments.

Examples of the cyan pigment may include, but are not limited to, C. I. Pigment Blue 1, C. I. Pigment Blue 2, C. I. Pigment Blue 3, C. I. Pigment Blue 15, C. I. Pigment Blue 15:1, C. I. Pigment Blue 15:3, C. I. Pigment Blue 15:4, C. I. Pigment Blue 16, C. I. Pigment Blue 22 and C. I Pigment Blue 60.

Examples of the magenta pigment may include, but are not limited to, C. I. Pigment Red 5, C. I. Pigment Red 7, C. I. Pigment Red 12, C. I. Pigment Red 48, C. I. Pigment Red 48:1, C. I. Pigment Red 57, C. I. Pigment Red 112, C. I. Pigment Red 122, C. I. Pigment Red 123, C. I. Pigment Red 146, C. I. Pigment Red 168, C. I. Pigment Red 184, C. I. Pigment Red 202 and C. I. Pigment Violet 1960.

Examples of the yellow pigment may include, but are not limited to, C. I. Pigment Yellow 1, C. I. Pigment Yellow 2, C. I. Pigment Yellow 3, C. I. Pigment Yellow 12, C. I. Pigment Yellow 13, C. I. Pigment Yellow 14, C. I. Pigment Yellow 16, C. I. Pigment Yellow 17, C. I. Pigment Yellow 55, C. I. Pigment Yellow 73, C. I. Pigment Yellow 74, C. I. Pigment Yellow 75, C. I. Pigment Yellow 83, C. I. Pigment Yellow 93, C. I. Pigment Yellow 95, C. I. Pigment Yellow 97, C. I. Pigment Yellow 98, C. I. Pigment Yellow 114, C. I. Pigment Yellow 128, C. I. Pigment Yellow 129, C. I. Pigment Yellow 150, C. I. Pigment Yellow 151, C. I. Pigment Yellow 154, C. I. Pigment Yellow 180 and C. I. Pigment Yellow 185.

Specific pigments such as red, green, blue, brown and white, metal gloss pigments such as gold and silver, colorless body pigments and plastic pigments as well as three primary color pigments of cyan, magenta and yellow can be used. Alternatively, a newly synthesized pigment for the invention can be used.

A self-dispersing pigment in which hydrophilic functional groups have been introduced in the surface of any of these pigments can also be used, which is preferred for the invention. The method for introducing hydrophilic functional groups may be of a known method or a newly conceived method. Examples of the method may include known methods such as oxidation treatment using an oxidizing agent (e.g., nitric acid, permanganate, bichromate, hypochlorite, ammonium persulfate, hydrogen peroxide, ozone, ozone water, or the like), treatment using a sulfonating agent, treatment using a coupling agent such as silane compound, polymer grafting treatment, plasma treatment, treatment using a diazonium salt compound having hydrophilic groups, as well as a newly conceived method, or a combination of any of these methods. The amount of the hydrophilic functional groups can be adjusted by controlling treatment concentration, time period, or the like. Alternatively, the functional groups on the surface of a commercially available self-dispersing pigment can be adjusted by modification such as esterification, or the like. The definition of the term "self-dispersing" is as mentioned in the explanation of the carbon black.

The dye is preferably a water soluble dye but not specifically limited thereto. The water soluble dye may be an acidic dye, a direct dye, a basic dye or a reactive dye, and more preferably an acidic dye or a direct dye.

Examples of the dye include the following dyes.

C. I. Direct blue -1, -2, -6, -8, -15, -22, -25, -34, -41, -70, -71, -76, -77, -78, -80, -86, -87, -90, -98, -106, -108, -112, -120, -142, -158, -163, -165, -168, -199, -200, -201, -202, -203, -207, -218, -236; -287 and -307;

C. I. Direct red -1, -2, -4, -8, -9, -11, -13, -15, -20, -23, -24, -28, -31, -33, -37, -39, -46, -51, -59, -62, -63, -73, -75, -79, -80, -81, -83, -87, -89, -90, -94, -95, -99, -101, -110, -189, -197, -201, -218, -220, -224, -225, -226, -227, -228, -229 and -230;

C. I. Direct Violet -107;

C. I. Direct Yellow -1, -2, -4, -8, -11, -12, -26, -27, -28, -33, -34, -39, -41, -44, -48, -50, -58, -85, -86, -87, -88, -89, -98, -100, -110, -132, -135, -142, -144 and -173;

C. I. Acid Blue 1, -7, -9, -15, -22, -23, -25, -27, -29, -40, -43, -55, -59, -62, -74, -78, -80, -81, -83, -90, -100, -102, -104, -111, -117,-127, -138, -158, -161, -185, -249 and -254;

C. I. Acid Red -1, -4, -6, -8, -9, -13, -14, -15, -18, -21, -26, -27-32, -35, -37, -42, -51, -52, -80, -83, -87, -89, -92, -106, -110, -114, -115, -133, -134, -144, -145, -158, -180, -198, -249, -257, -265 and -289;

C. I. Acid Yellow -1, -3, -4, -7, -11, -12, -13, -14, -17, -18, -19, -23, -25, -29, -34, -36, -38, -40, -41, -42, -44, -53, -55, -61, -71, -76, -78, -79, -98, -99 and -122;

C. I. Reactive Blue -4, -5, -7, -13, -14, -15, -18, -19, -21, -26, -27, -29, -32, -38, -40, -44 and -100;

C. I. Reactive Red -7, -12, -13, -15, -17, -20, -23, -24, -29, -31, -42, -45, -46, -59, C. I. Food Red -87, -92 and -94;

M-377 (manufactured by ILFORD, Inc.);

C. I. Reactive Yellow -2, -3, -17, -25, -37 and -42;

C. I. Food Yellow -3;

Y-104 and Y-1189 (manufactured by ILFORD, Inc.);

C. I. Direct Black -2, -4, -9, -11, -17, -19, -22, -32, -80, -151, -154, -168, -171, -194 and -195;

C. I. Food black -1 and -2; and

C. I. Acid black -1, -2, -7, -16, -24, -26, -28, -31, -48, -52, -63, -107, -112, -118, -119, -121, -156, -172, -194 and -208.

The colorants as listed above can be used solely, or can be used in combination of two or more kinds. Alternatively, the colorants can be toned to be any of three primary colors of cyan, magenta and yellow, or to a custom color such as red, blue and green.

The colorant preferably has a decomposition temperature of less than 400° C., and preferably has a weight loss percentage by heat decomposition at the temperature of 300° C. to 400° C. of not less than 8%, more preferably 8.5% to 25%, and more preferably 9% to 20%. When a thermal ink jet system is used as an ink ejection system and ink including a colorant having a weight loss percentage in the above-mentioned range is used, the colorant can be easily decomposed when heat energy is applied to the ink from a heat generating resistor layer, whereby the force due to cavitation is concentrated locally in the heat generating resistor layer. However, when the dynamic contact angle of the ink is in the above-mentioned range, local concentration of cavitation in the heat generating resistor layer can be suppressed even if the colorant is decomposed, which can lead longer lifetime of the heater.

Preferable examples of the colorant having a weight loss percentage of the above-mentioned range include the following materials: C. I. Acid Blue -9 (weight loss percentage: 17.5%), C. I. Acid Yellow -23 (weight loss percentage: 13.6%), C. I. Acid Red -52 (weight loss percentage: 15.4%), C. I. Direct Yellow -132 (weight loss percentage: 9.6%), C. I. Direct Yellow -144 (weight loss percentage: 9.8%), C. I. Direct Black -19 (weight loss percentage: 16.3%), C. I. Direct Black -154 (weight loss percentage: 12.4%) and C. I. Direct Black -168 (weight loss percentage: 11.5%).

The weight loss percentage is evaluated by subjecting a dried colorant to thermal gravity analysis (TG) measurement, wherein the material is heated from the initial temperature (15° C. to 35° C.) to not less than 400° C., and calculating the percentage of the difference of weight at 300° C. and weight at 400° C. relative to the weight of the colorant at the initial temperature.

The content of the colorant is preferably not less than 5% by mass, more preferably 5% by mass to 10% by mass, and even more preferably 5% by mass to 8% by mass. By incorporating the colorant in the preferable ink by the concentration of the above-mentioned range, image quality of high concentration can be realized even small amount of liquid droplets are used, whereas the amount of the colorant to be decomposed by application of heat energy from the heat generating resistor layer increases as mentioned above. However, when the dynamic contact angle of the ink is in the above-mentioned range, local concentration of cavitation in the heat generating resistor layer can be suppressed even if the amount of the decomposed colorant increases, which can lead longer lifetime of the heater.

It is desirable that the colorant is purified by removing impurities incorporated during the production steps therefor, for example, impurities such as residual oxidizing agent, treatment agent and by-product, and other inorganic or organic impurities from the colorant. Specifically, it is desirable that calcium, iron and silicon in the ink are each adjusted to not more than 10 ppm, preferably not more than 5 ppm. The content of these inorganic impurities can be measured by, for example, by inductively coupled plasma emission spectroscopy.

These impurities can be removed by, for example, a method such as washing with water, a method such as reverse osmosis membrane, ultrafiltration membrane or ion exchange method or a method for adsorption using an active carbon or zeolite. These methods can be carried out solely or in combination.

When a pigment is used as a colorant, a dispersant can be used for dispersing the pigment.

Water Soluble Organic Solvent

Examples of the water soluble organic solvent includes polyhydric alcohols such as ethyleneglycol, diethyleneglycol, propyleneglycol, dipropyleneglycol, butyleneglycol, triethyleneglycol, 1,5-pentanediol, 1,2,6-hexanetriol, trimethylolpropane, glycerine and polyethyleneglycol; lower alcohols such as ethanol, isopropyl alcohol and 1-propanol; nitrogen-containing solvents such as pyrrolidone, N-methyl-2-pyrrolidone, cyclohexylpyrrolidone and triethanolamine; sulfur-containing solvents such as thiodiethanol, thiodiglycerol, sulforane and dimethylsulfoxide; propylene carbonate and ethylene carbonate; sugars such as glucose, fructose, galactose, mannose and xylose and derivatives thereof and sugar alcohols thereof.

These water soluble organic solvents may be used solely or as a mixture of two or more kinds. The content of the water soluble organic solvent is 1% by mass to 60% by mass, preferably 5% by mass to 40% by mass relative to the ink.

Water

Water is preferably ion exchange water, ultrapure water, distilled water or ultrafiltered water, especially for preventing contamination by impurities.

Coagulant

Preferable examples of the coagulant may include polyvalent metal salts in view of color ink stability.

The polyvalent metal salt means a salt that produces cation of equal to or more than divalent derived from metal element when dissolved in water. Examples of the polyvalent metal ion include aluminum ion, barium ion, calcium ion, copper ion, iron ion, magnesium ion, manganese ion, nickel ion, tin ion, titanium ion and zinc ion.

Specific example of the polyvalent metal salt may include a salt of the polyvalent metal ion with hydrochloric acid, hydrobromic acid, hydroiodic acid, sulfuric acid, nitric acid, phosphoric acid or thiocyanic acid, an organic carboxylic acid such as acetic acid, oxalic acid, lactic acid, fumaric acid, phthalic acid, citric acid, salicylic acid or benzoic acid, or an organic sulfonic acid.

More specifically, examples thereof may include aluminum chloride, aluminum bromide, aluminum sulfate, aluminum nitrate, sodium aluminum sulfate, potassium aluminum sulfate, aluminum sulfate, barium chloride, barium bromide, barium iodide, barium oxide, barium nitrate, barium thiocyanate, calcium chloride, calcium bromide, calcium iodide, calcium nitrite, calcium nitrate, calcium dihydrophosphate, calcium thiocyanate, calcium benzoate, calcium acetate, calcium salicylate, calcium tartrate, calcium lactate, calcium fumarate, calcium citrate, copper chloride, copper bromide, copper sulfurate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfurate, titanium chloride, zinc chloride, zinc bromide, zinc sulfate, zinc nitrate, zinc thiocyanate and zinc acetate.

Preferable examples of the polyvalent metal salt may include aluminum sulfate, calcium chloride, calcium nitrate, calcium acetate, magnesium chloride, magnesium nitrate, magnesium sulfate, magnesium acetate, tin sulfurate, zinc chloride, zinc nitrate, zinc sulfurate, zinc acetate and aluminum nitrate.

A monovalent electrolyte, a hydrophobic nonionic surfactant, an anionic surfactant and a hydrophobic water soluble solvent can be used as a coagulant besides the above-mentioned polyvalent metal salt by the amount of not less than the amount sufficient to prevent the dispersion of the carbon black. Examples of the monovalent electrolyte may include, for example, inorganic salts such as sodium chloride, sodium sulfate, sodium sulfite and sodium nitrate, salts of an organic acid such as acetic acid, lactic acid, benzoic acid or citric acid with an alkaline substance. Examples of the surfactant having high hydrophobicity include, for example, a surfactant having an HLB of not more than 10, preferably an HLB of not more than 5. Examples of the hydrophobic water soluble solvent include, for example, a substance having an SP value of not more than 12, preferably not more than 10.

Specifically, in the case where the pigment of black ink (a dispersant thereof or functional groups for self-dispersing) or a water soluble polymer included in the black ink is cationic, inorganic and organic salts which generate divalent or more anion, and polymers having anionic groups can be used as a coagulant. Examples of the inorganic and organic salts, which generate divalent or more anion include compounds comprising a salt with sulfuric acid, sulfinic acid, phosphoric acid or phosphonic acid, an organic carboxylic acid such as oxalic acid, fumaric acid, phthalic acid, citric acid or tartaric acid, or an organic sulfonic acid.

Alternatively, the above-mentioned electrolytes that used in the case where the pigment of black ink (a dispersant thereof or functional groups for self-dispersing) or a water soluble polymer included in the black ink is anionic, can also be used.

Dispersant

Examples of the dispersant may include a surfactant and a water soluble resin, and water soluble resin is preferable for use in dispersing.

Examples of the water soluble resin used as a dispersant may include known water soluble resins such as polymers obtained by polymerization and naturally-derived resins, and (co)polymers are preferable. Preferable example of the copolymer to be used includes a copolymer obtained by at least one kind of monomer having an α, β-ethylenically unsaturated group that constitutes hydrophilic portion and at least one kind of monomer having an α, β-ethylenically unsaturated group that constitutes hydrophobic portion. Alternatively, a homopolymer of a monomer having an α, β-ethylenically unsaturated group including a hydrophilic group can also be used.

Examples of the monomer having an α, β-ethylenically unsaturated group that constitutes hydrophilic portion may include monomers having carboxylic group, sulfonic acid group, hydroxyl group or polyoxyethylene, preferably carboxylic group- or sulfonic acid group-containing monomers such as acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid and sulfonated vinylnaphthalene. Among these, more preferred are carboxylic group-containing monomers, and examples thereof include, but are not limited to, acrylic acid, methacrylic acid, maleic acid, crotonic acid, itaconic acid, itaconic acid monoester, maleic acid, maleic acid monoester, fumaric acid and fumaric acid monoester.

Examples of the monomer having an α, β-ethylenically unsaturated group that constitutes hydrophobic portion include, but not limited to, styrene derivatives such as styrene, α-methylstyrene and vinyltoluene, vinylnaphthalene, vinylnaphthalene derivatives, acrylic acid alkyl ester, methacrylic acid alkyl ester, crotonic acid alkyl ester, itaconic acid dialkyl ester and maleic acid dialkyl ester.

Although the weight average molecular weight of the polymer used as a water soluble resin is not specifically limited, it is preferably in the range of 3000 to 15000, more preferably 4000 to 7000. If the molecular weight is less than the range, stability in dispersion deteriorates. On the other hand, if the molecular weight exceeds 15000, the viscosity of ink increases, which easily lead to deterioration of the ejection property of ink. Various methods for the measurement of the average molecular weight of the copolymer are known. In the invention, the average molecular weight is defined as a value measured using GPC (gel permeation chromatography).

The dispersant is preferably used as a copolymer or a neutralized salt thereof. The neutralization is carried out by using various basic substances, preferably by using basic substances comprising at least one kind of alkali metal hydroxide. Examples of the alkali metal hydroxide may include NaOH, KOH and LiOH, preferably NaOH.

Water Soluble Polymer Having Anionic Group

The water soluble polymer having anionic group may be a polymer that interacts with a coagulant included in other ink (preferably a polyvalent metal salt) to aggregate ink. In the case where a pigment dispersant is used, it may be the same as the dispersant.

Examples of the water soluble resins may include known water soluble resins such as polymers obtained by polymerization and naturally-derived resins, and (co)polymers may be preferable. Preferable example of the copolymer to be used includes a copolymer obtained by copolymerization of at least one kind of monomer having an α, β-ethylenically unsaturated group that constitutes hydrophilic portion and at least one kind of monomer having an α, βethylenically unsaturated group that constitutes hydrophobic portion. Alternatively, a homopolymer of a monomer having an α, β-ethylenically unsaturated group including a hydrophilic group can also be used.

Examples of the monomer having an α, β-ethylenically unsaturated group that constitutes anionic hydrophilic portion may include monomers having carboxylic group or sulfonic acid group such as acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid and sulfonated vinylnaphthalene. Among these, more preferred are carboxylic group-containing monomers, and examples thereof include, but are not limited to, acrylic acid, methacrylic acid, maleic acid, crotonic acid, itaconic acid, itaconic acid monoester, maleic acid, maleic acid monoester, fumaric acid and fumaric acid monoester.

Examples of the monomer having an α, β-ethylenically unsaturated group that constitutes hydrophobic portion may include, but are not limited to, styrene derivatives such as styrene, α-methylstyrene and vinyltoluene, vinylnaphthalene, vinylnaphthalene derivatives, acrylic acid alkyl ester, methacrylic acid alkyl ester, crotonic acid alkyl ester, itaconic acid dialkyl ester and maleic acid dialkyl ester.

The acid value of the water soluble polymer is preferably 100 to 300, more preferably 130 to 200. If the acid value is less than the range, the stability of ink tends to be deteriorated easily. On the other hand, if the acid value is too high, image density tends to be low.

Although the weight average molecular weight of the water soluble polymer is not specifically limited, it is preferably in the range of 3000 to 10000, more preferably 4000 to 7000. If the molecular weight is less than the range, the image density tends to be low. On the other hand, if the molecular weight exceeds 10000 the viscosity of ink increases, which easily leads to deterioration of the ejection property of ink. Various methods for the measurement of the average molecular weight of the copolymer are known. In the invention, the average molecular weight is defined as a value measured using GPC (gel permeation chromatography).

The water soluble polymer is preferably used as a copolymer or a neutralized salt thereof. The neutralization is carried out by using various basic substances, preferably by using basic substances comprising at least one kind of alkali metal hydroxide. Examples of the alkali metal hydroxide may include NaOH, KOH and LiOH, preferably NaOH.

Other Additives

Various penetrants are used for adjusting drying time of ink. As a penetrant, surfactants and penetrating solvents are preferred.

Examples of the surfactant include various anionic surfactants, nonionic surfactants, cationic surfactants and amphoteric surfactants. Preferably, anionic surfactants and nonionic surfactants are used.

Hereinafter, specific examples of the surfactant are mentioned.

Examples of the anionic surfactant may include alkylbenzenesulfonic acid salt, alkylphenylsulfonic acid salt, alkylnaphthalenesulfonic acid salt, higher fatty acid salt, sulfuric acid ester salt of higher fatty acid ester, sulfonic acid salt of higher fatty acid ester, sulfuric acid ester salt and sulfonic acid salt of higher alcohol ether, higher alkylsulfosuccinic acid salt, polyoxyethylenealkyl ethercarboxylic acid salt, polyoxyethylenealkyl ethersulfuric acid salt, alkylphosphoric acid salt and polyoxyethylenealkyl etherphosphoric acid salt, preferably dodecylbenzenesulfonic acid salt, isopropylnaphthalenesulfonic acid salt, monobutylphenylphenol monosulfonic acid salt, monobutylbiphenylsulfonic acid salt, monobutylbiphenylsulfonic acid salt and dibutylphenylphenoldisulfonic acid salt.

Examples of the nonionic surfactant may include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene sorbitol fatty acid ester, glycerine fatty acid ester, polyoxyethyleneglycerine fatty acid ester, polyglycerine fatty acid ester, sucrose fatty acid ester, polyoxyethylenealkylamine, polyoxyethylene fatty acid amide, alkylalkanol amide, polyethyleneglycolpolypropyleneglycol block copolymer, acetylene glycol and polyoxyethylene adduct of acetylene glycol, preferably polyoxyethylene adducts such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethyleneglycol polypropyleneglycol block copolymer, acetylene glycol and polyoxyethylene adduct of acetylene glycol.

In addition, silicone surfactants such as polysiloxaneoxyethylene adduct, fluorine-based surfactants such as perfluoroalkyl carboxylic acid salt, perfluoroalkyl sulfonic acid salt and oxyethylene perfluoroalkyl ether, biosurfactants such as spiculisporic acid, rhamnolipid and lysolecithin.

These surfactants may be used solely or as a mixture. The HLB of the surfactant is preferably in the range of 3 to 20 in view of solution stability, or the like.

The amount of the surfactant to be added is preferably 0.001% by mass to 5% by mass, specifically preferably 0.01% by mass to 3% by mass.

Alternatively, as a penetrant, a compound of the formula (1) may be used as a penetrant:

$$R—O—XnH \quad (1)$$

wherein R is a functional group selected from a $C_4$–$C_8$ alkyl group, a $C_4$–$C_8$ alkenyl group, a $C_4$–$C_8$ alkynyl group, a phenyl group, an alkylphenyl group, an alkenylphenyl group and a cycloalkyl group; X is an oxyethylene group or an oxypropylene group; and n is an integer from 1 to 4.

Examples of the compound of the above-mentioned formula (1) as a penetrant include ethyleneglycol monobutyl ether, diethyleneglycol monobutyl ether, propyleneglycol monobutyl ether, diethyleneglycol monohexyl ether, dipropyleneglycol monobutyl ether, triethyleneglycol monobutyl ether, triethyleneglycol monohexyl ether, diethyleneglycol monocyclohexyl ether, triethyleneglycol monophenylethyl ether and dioxypropyleneoxyethylene monopentyl ether, preferably diethyleneglycol monobutyl ether.

The compound of the above-mentioned formula (1) as a penetrant may be preferably contained in ink by the amount of 1% by mass to 20% by mass more preferably 1% by mass to 10% by mass relative to whole amount of the ink. When the content of the compound exceeds 20% by mass, bleeding proceeds and ejection may be destabilized. On the other hand, when the content of the compound is less than 1% by mass, the effect of addition may not be obtained.

In addition, urea or urea derivative may be contained in the ink. Examples of the urea and urea derivative may include urea, 1,1-dimethylurea, 1,3-dimethylurea, 1,1-diethylurea and 1,3-diethylurea, preferably urea. The content of urea or urea derivative is 1% by mass to 10% by mass, preferably 3% by mass to 8% by mass relative to the ink. When the content is less than 1% by mass, the effect for preventing nozzle clogging is small. On the other hand, when the content exceeds 10% by mass, bleeding of image increases and the concentration tends to decrease.

If necessary, a pH adjusting agent may be contained in the ink for adjusting pH. Preferable examples thereof may include acids such as hydrochloric acid, sulfuric acid, nitric acid, acetic acid, citric acid, oxalic acid, malonic acid, boronic acid, phosphoric acid, phosphorous acid and lactic acid, bases such as potassium hydroxide, sodium hydroxide, lithium hydroxide, ammonium hydroxide, triethanolamine, diethanolamine, ethanolamine, 2-amino-2-methyl-1-propanol and ammonia, pH buffers such as phosphoric acid salt, oxalic acid salt and amine salt and Good's buffer.

For controlling the properties of ink, poly N-vinylacetoamide, polyvinylalcohol, polyvinylpyrrolidone, polyethyleneglycol, cellulose derivatives such as ethylcellulose and carboxymethylcellulose, polysaccharides and derivatives thereof, other water soluble polymers, polymer emulsions such as acrylic polymer emulsion and polyurethane emulsion, cross-linked polymers such as cross-linked poly N-vinylacetoamide or acrylic polymer, cyclodextrin, macrocyclic amines, dendrimer, crown ethers may be used.

If necessary, known fungicide, antiseptic or antioxidant such as benzoic acid, 1,2-benzisothiazolin-3-one and dehydroacetic acid, a viscosity adjusting agent, an electroconductive agent, an ultraviolet absorber and a chelating agent may be contained in the ink.

The surface tension of the ink is preferably not less than 30 mN/m and less than 65 mN/m, more preferably not less than 35 mN/m and less than 55 mN/m, and even more preferably 40 mN/m to 50 mN/m. When the surface tension is in the above-mentioned range, penetration of ink droplets to the recording medium is retarded, whereby absorbing efficiency of the excess liquid in the liquid absorbing device is enhanced.

The surface tension can be measured under the environment of 23° C. and 55% RH using a surface tension meter (trade name: CVBP-Z, manufactured by Kyowa Interface Science Co., Ltd.).

The viscosity of ink is preferably not less than 2.0 mPa·s and less than 10.0 mPa·s, more preferably not less than 2 mPa·s and less than 8.0 mPa·s. When the viscosity is in the above-mentioned range, ink droplets can be formed stably during ejection from the head.

The viscosity can be measured using TVE-20L (trade name, manufactured by Toki Sangyo Co., Ltd.) as a measurement device. The measurement is carried out under the condition of the temperature of 23° C. and the share rate of 750 $s^{-1}$.

Next, the operation of the ink jet recording device 10 having the above-mentioned structure is explained.

During a printing operation, paper is fed from the paper feeding portion 12. The position and timing of the paper is controlled by the registration adjusting portion 14, and the paper is conveyed to the recording portion 16.

At the recording portion 16, a motor (not depicted) is driven and the driving force therefrom is transmitted to all of the conveying rolls 40 via a plane belt.

The paper that has arrived at the recording portion 16 is then inserted between the conveying roll 40 and the star wheel 42 located furthest toward the upstream side in the conveying direction. During this operation, the star wheel 42 urged by a spring (not depicted) presses the paper to the conveying roll 40, whereby conveying force is transmitted, with certainty, from the conveying roll 40 to the paper. The driving force is transmitted from the conveying rolls 40 provided between the recording heads 28 at a constant rate, whereby the paper is conveyed.

When a printing signal is input from the controlling portion of the device to the recording heads 28, the heat generating elements of the nozzles generate heat in response to the printing signal and ink is ejected from the nozzles to the paper while the paper is conveyed with a distance to the nozzle surface being kept constant.

By printing using the recording heads 28, printing with one color of ink on the corresponding portions of the paper is completed all at once across the maximum recording area width of the recording medium. As such, as the paper is conveyed in the recording portion 16, printing is carried out by each of the recording heads 28K, 28C, 28M and 28Y in this order, whereby full-color printing is completed.

Next, the excess liquid of the ink of each color remaining on the paper is absorbed by the liquid absorbing devices 34K to 34Y respectively provided at the downstream sides of the recording heads 28K to 28Y (absorbing operation).

The paper on which an image has been printed with the ink arrives at the paper ejecting portion 18 and is loaded into the tray 38 via the paper ejecting belt 36.

As mentioned above, in embodiments of the invention, excess liquid of the ink remaining on the paper is absorbed by the liquid absorbing device 34. In the liquid absorbing device of the embodiment, since a surface which contacts the excess liquid is hydrophilic, the excess liquid, which mainly includes water, is not released from the surface and is well absorbed by the surface. Furthermore, since the ink (excess liquid) itself is not repelled by the surface, mixing of colors in the excess liquid can be prevented, and image quality can be improved, even in the case where plural inks of different colors exist at positions that are close to each other. Furthermore, since the hydrophilic surface has the residual fine particle ratio in the above-mentioned range, the liquid absorbing device does not absorb colorants and selectively absorb only the excess liquid.

In addition, since the excess liquid of the ink of remaining on the paper is respectively absorbed for each color, for example, high-speed printing at not less than 10 pages per minute can be realized while color bleeding (feathering, ICB), and the like is prevented.

Moreover, in embodiments of the invention, even in the case where the colorant and the excess liquid are not easily separated, it is possible to absorb only the excess liquid without absorbing the colorant by using the liquid absorbing device 34 including the hydrophilic layer 54 having the above-described structure (residual fine particle ratio, pore diameter, and area percentage of pores).

Moreover, in embodiments of the invention, since the recording heads 28 and the liquid absorbing devices 34 have a printing area (absorbing area) corresponding to the maximum paper width (PW) of the paper, the whole width of the paper can be printed without requiring scanning of the recording heads 28, whereby uneven drying and penetration of the ink deposited on the paper does not easily occur and the excess liquid of the ink can be absorbed by the liquid absorbing device 34 in this state. Therefore, curling and cockle can be prevented and drying property can be improved more effectively.

In addition, embodiments of the invention can be applied to a printing device in which unit recording heads (short heads) are arranged in the width direction of the paper.

EXAMPLES

Hereinafter, the present invention is more specifically explained with reference to Examples. However, the invention is not limited to the Examples.

<Ink>

A water soluble organic solvent, a surfactant, ion exchange water, a coloring agent solution, and the like are mixed to obtain the predetermined composition shown below, and the mixed liquid is stirred. The obtained liquid is passed through a filter (mesh size: 5 μm) to obtain ink. The viscosity of the ink is 2.4 mPa·s, and the surface tension thereof is 36 mN/m.

Composition

Bonjet Black CW-2 (manufactured by Orient Chemical Industry, Inc.) pigment component: 5% by mass Glycerine: 10% by mass Olfin E1010 (manufactured by Nisshin Chemical, Inc.): 1% by mass Water: reminder of the composition <Absorbing Member (Liquid Absorbing Device)>

An absorbing member is prepared as follows. A hydrophilic layer of cellulose having a thickness of 5 μm is provided on hydrophilic porous polyurethane (absorbing layer). The hydrophilic layer is formed by winding a sheet of cellulose around the absorber. The hydrophilic layer has many pores having an average pore diameter of 1.0 μm, and the area percentage of the pores is 60% relative to the surface of the hydrophilic layer.

When a water dispersion liquid containing 20% of fine particles having the average particle size of 5 μm is filtered through this hydrophilic layer alone, 98% of the fine particles remain on the surface. When a water dispersion liquid containing 20% of fine particles having the average particle size of 3 μm is filtered, 95% of the fine particles remain on the surface.

The composition used for the above-mentioned fine particle dispersion liquid is as follows. For the dispersion liquid of fine particles of 3 μm, a dispersion liquid in which the fine particles are replaced with resin particles.

Composition

Polystyrene having an average particle size of 5.0 μm: 10% by mass

Surfinol 465 (trade name): manufactured by Nisshin Chemical Co., Ltd.: 1% by mass Ion exchange water: 89% by mass The contact angle of the hydrophilic layer of the Example relative to ink is as follows. The contact angle when a liquid including Surfinol 465 (trade name, manufactured by Nisshin Chemical Co., Ltd., 1%) and ion exchange water (99%) is applied dropwise on the surface of the hydrophilic layer, is measured using a Face CA-DT type contacting meter, whereby a contact angle of 24° is obtained.

Example 1 and Comparetive Example 2

Solid printing is carried out at 720×360 dpi using a PM-970C ink jet printer (trade name, manufactured by Seiko Epson Co., Ltd.) equipped with the above-mentioned ink and the absorbing member. Curling, cockle and antiabrasion property of the recorded material are evaluated. The results are shown in Table 1.

The evaluation method is as follows.

Curling and Cockle 3 seconds after printing, the recorded material is placed on a flat surface, and lifting at the four end portions of the paper surface is measured. The criteria for the evaluation is as follows.

a: Not more than 5 mm of lifting.

b: Not less than 6 mm of lifting.

Antiabrasion Property

Disturbance of the image caused by rubbing the printed portion of the recorded material with fingers 3 seconds after printing is evaluated. The criteria for the evaluation is as follows.

a: Colorant does not adhere to fingers.

b: Colorant adheres to fingers.

TABLE 1

| | Example 1 | Comparative Example 2 |
|---|---|---|
| Presence or absence of absorbing member | Present | Absent |
| Curling and cockle | A | B |
| Antiabrasion property | A | B |

As is apparent from the results in Table 1, an image having no curling or cockle can be obtained in Example 1. Furthermore, the surface of the recorded image after ejection exhibits no transfer of ink when it is touched with fingers and has excellent drying property. In addition, a fine image that undergoes no bleeding during printing can be obtained.

According to the ink jet recording device and the method for ink jet recording of the invention, it is possible to absorb only the excess liquid of ink deposited on the recording medium, setting-off of the ink to other recording medium due to drying failure, curling and cockle can be prevented, drying property of ink can be improved, and a fine image can be provided. In a case where the surface of a liquid absorbing device is hydrophobic, there is a problem in that ink (excess liquid) itself is also repelled by the surface, whereby mixing of colors in the excess liquid occurs and the image quality is deteriorated when inks having different colors exist in the vicinity of each other. However, according the invention, mixing of colors in the excess liquid can be prevented, and image quality can be improved.

What is claimed is:

1. An ink jet recording apparatus comprising:

a recording head for depositing ink on a recording medium; and a liquid absorbing device for absorbing excess liquid of the ink remaining on the recording medium after the depositing of the ink on the recording medium using the recording head, wherein the liquid absorbing device comprises an absorber comprising a hydrophilic surface which contacts the excess liquid, and the hydrophilic surface has a residual fine particle ratio of not less than about 90%, the residual fine particle ratio being a ratio of fine particles remaining on the hydrophilic surface when fine particles having an average particle size of about 5 μm are filtered by the hydrophilic surface.

2. The ink jet recording apparatus of claim 1, wherein the absorber comprises a hydrophilic layer which comprises a hydrophilic material and contacts the excess liquid, and an absorbing layer which absorbs the excess liquid through the hydrophilic layer.

3. The ink jet recording apparatus of claim 2, wherein the hydrophilic layer is provided with a plurality of pores.

4. The ink jet recording apparatus of claim 3, wherein a diameter of the pores is about 0.5 μm to about 50 μm.

5. The ink jet recording apparatus of claim 3, wherein an area percentage of the pores is about 10% to about 70% relative to an area of a surface of the hydrophilic layer.

6. The ink jet recording apparatus of claim 2, wherein the absorbing layer comprises a porous body.

7. The ink jet recording apparatus of claim 2, wherein the absorbing layer comprises a fibrous body.

8. The ink jet recording apparatus of claim 2, wherein the liquid absorbing device is a roll-type device.

9. The ink jet recording apparatus of claim 2, wherein the liquid absorbing device is a belt-type device.

10. A method for ink jet recording, comprising:

depositing ink on a recording medium using a recording head; and absorbing excess liquid of the ink remaining on the recording medium using a liquid absorbing device for absorbing the excess liquid, wherein the liquid absorbing device is included in an ink jet recording apparatus and comprises an absorber comprising a hydrophilic surface which contacts the excess liquid, and the hydrophilic surface has a residual fine particle ratio of not less than about 90%, the residual fine particle ratio being a ratio of fine particles remaining on the hydrophilic surface when fine particles having an average particle size of about 5 μm are filtered by the hydrophilic surface.

* * * * *